US007186146B1

(12) United States Patent
Chang et al.

(10) Patent No.: US 7,186,146 B1
(45) Date of Patent: Mar. 6, 2007

(54) ELECTRIC APPLIANCE/EXTENSION CORD ASSEMBLY WITH ELECTROMAGNETIC RADIATION-SHIELDING FUNCTION

(76) Inventors: Pen Yen Chang, No. 11, Lane 40, Jyuguang Rd., Banciao City, Taipei County (TW); Kuo Hung Liao, No. 7, Lane 5, Siwei St., Sanchong City, Taipei County (TW); Pen Han Chang, No. 18, Lane 137, Yanping St., Yongkang City, Tainan County (TW)

( * ) Notice: Subject to any disclaimer, the term of this patent is extended or adjusted under 35 U.S.C. 154(b) by 0 days.

(21) Appl. No.: 11/307,479

(22) Filed: Feb. 9, 2006

(51) Int. Cl.
*H01R 33/94* (2006.01)

(52) U.S. Cl. ..... 439/650; 174/350

(58) Field of Classification Search ..... 174/51, 174/350, 353; 439/607, 610, 650, 651, 652, 439/931
See application file for complete search history.

(56) References Cited

U.S. PATENT DOCUMENTS 5,708,554 A * 1/1998 Liner ..... 361/104
6,538,421 B1 * 3/2003 Carpenter ..... 324/127
6,666,712 B1 * 12/2003 Kramer ..... 439/501
6,844,494 B1 * 1/2005 Nevins ..... 174/53
6,940,015 B2 * 9/2005 Fang ..... 174/53
7,154,402 B2 * 12/2006 Dayoub ..... 340/628

* cited by examiner

*Primary Examiner*—Thanh-Tam Le
(74) *Attorney, Agent, or Firm*—Banger Shia

(57) ABSTRACT

An electric appliance/extension cord assembly includes an electric appliance and an extension cord. The electric appliance includes a body having a plug with three prongs. The body further c includes a housing and a shielding conductive layer in the housing. The shielding conductive layer is electrically connected to a grounding prong of the plug of the electric appliance. The extension cord includes a casing and a plug. The casing includes a plurality of three-slot sockets. The plug of the extension cord is coupled with a two-slot socket. The plug of the electric appliance is coupled with one of the three-slot sockets of the extension cord. The extension cord further includes a detecting circuit for detecting a hot wire and a neutral wire of the two-slot socket.

3 Claims, 2 Drawing Sheets

ELECTRIC APPLIANCE/EXTENSION CORD ASSEMBLY WITH ELECTROMAGNETIC RADIATION-SHIELDING FUNCTION

BACKGROUND OF THE INVENTION

1. Field of the Invention

The present invention relates to an electric appliance/extension cord assembly, and more particularly to an electric appliance/extension cord assembly that provides an electromagnetic radiation-shielding function.

2. Description of the Related Art

An electric appliance operates when supplied with electricity and generates electromagnetic radiation that adversely affects the human body during operation. A household wall socket may have only two slots, i.e., without the grounding slot. The user has to break and remove the grounding prong of the plug of the electric appliance. The electromagnetic shielding effect provided by the grounding prong is lost. In a case that the electromagnetic appliance includes a built-in electromagnetic radiation-eliminating device, such an electromagnetic radiation-eliminating device can work only when the plug of the electric appliance is coupled with a three-slot socket having a grounding slot. Namely, electromagnetic radiation still exists when the plug of the electric appliance is coupled with a two-slot socket without a grounding slot.

SUMMARY OF THE INVENTION

An objective of the present invention is to provide an electric appliance/extension cord assembly with an electromagnetic radiation-shielding function.

Another objective of the present invention is to provide an electric appliance/extension cord assembly for detecting a hot wire and a neutral wire of a two-slot socket.

An electric appliance/extension cord assembly with an electromagnetic radiation-shielding function in accordance with the present invention comprises an electric appliance and an extension cord. The electric appliance comprises a body having a plug with three prongs. The body further comprises a housing and a shielding conductive layer in the housing. The shielding conductive layer is electrically connected to a grounding prong of the plug of the electric appliance. The extension cord comprises a casing and a plug. The casing comprises a plurality of three-slot sockets. The plug of the extension cord is adapted to couple with a two-slot socket. The plug of the electric appliance is coupled with one of the three-slot sockets of the extension cord. The extension cord further comprises a detecting circuit for detecting a hot wire and a neutral wire of the two-slot socket.

Preferably, the detecting circuit comprises a slide switch and an indicator lamp. The slide switch comprises a metal housing. The indicator lamp is electrically connected in series to a resistor.

Preferably, the extension cord further comprises a grounding circuit mounted between the neutral wire of the two-slot socket and a grounding slot of the three-slot socket. The grounding circuit comprises a resettable positive temperature coefficient electric fuse or a meltable fuse.

Other objectives, advantages, and novel features of the invention will become more apparent from the following detailed description when taken in conjunction with the accompanying drawings.

DETAILED DESCRIPTION OF THE INVENTION

Figure 1:
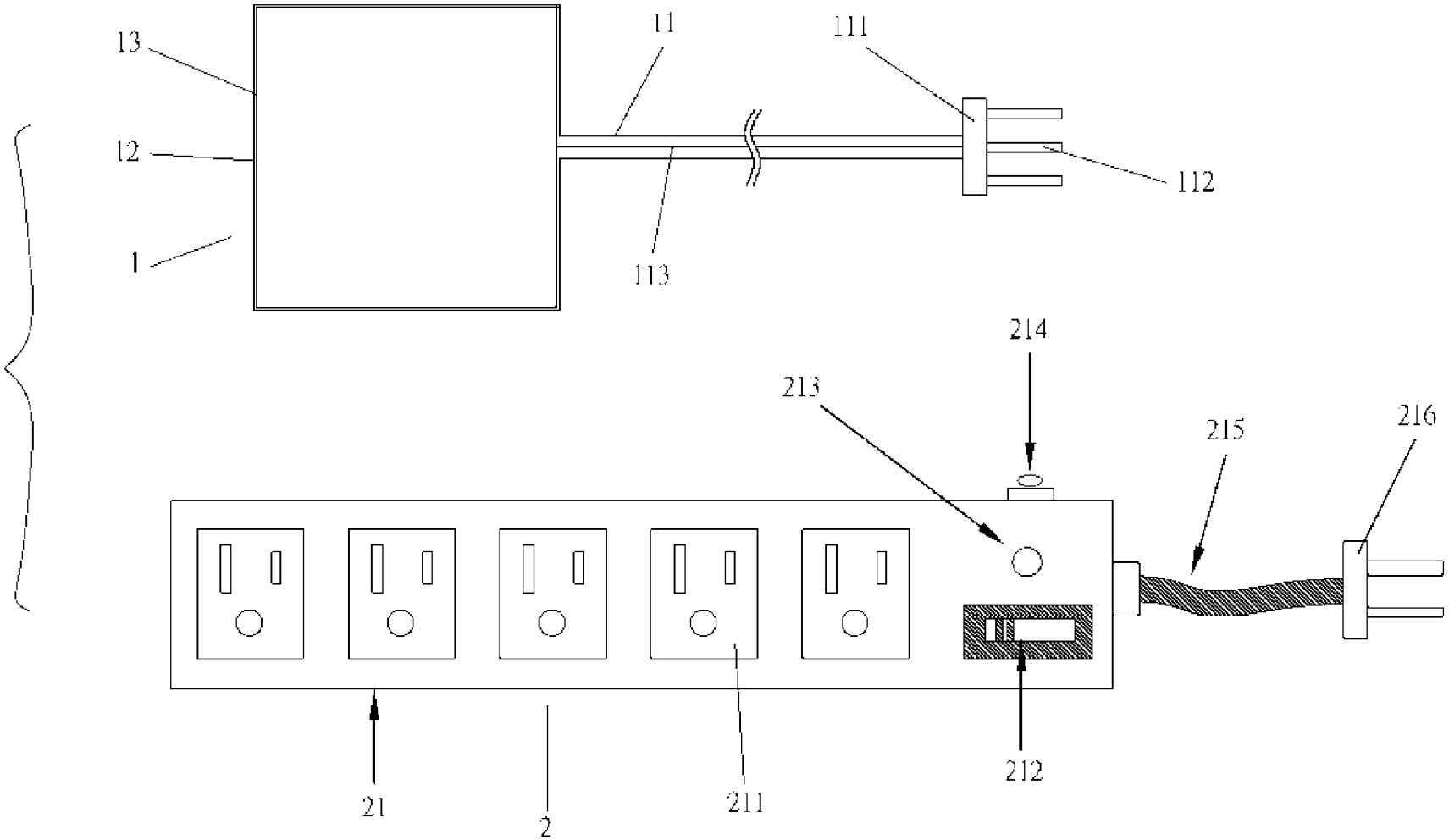
FIG. 1 is a schematic view of an electric appliance/extension cord assembly in accordance with the present invention.

Referring to FIG. 1, an electric appliance/extension cord assembly in accordance with the present invention comprises an electric appliance having a body 11 and an extension cord 2. A power line 11 extends from the electric appliance body 11 and includes a plug 111 on an end of the power line 11. The plug 111 includes three prongs including a grounding prong 112. The electric appliance 11 includes a housing 12 and a shielding conductive layer 13 inside the housing 12. The shielding conductive layer 13 may be made of a metal net, conductive rubber, conductive painting, etc. The shielding conductive layer 13 is electrically connected to the grounding prong 112 of the plug 111.

Figure 2:
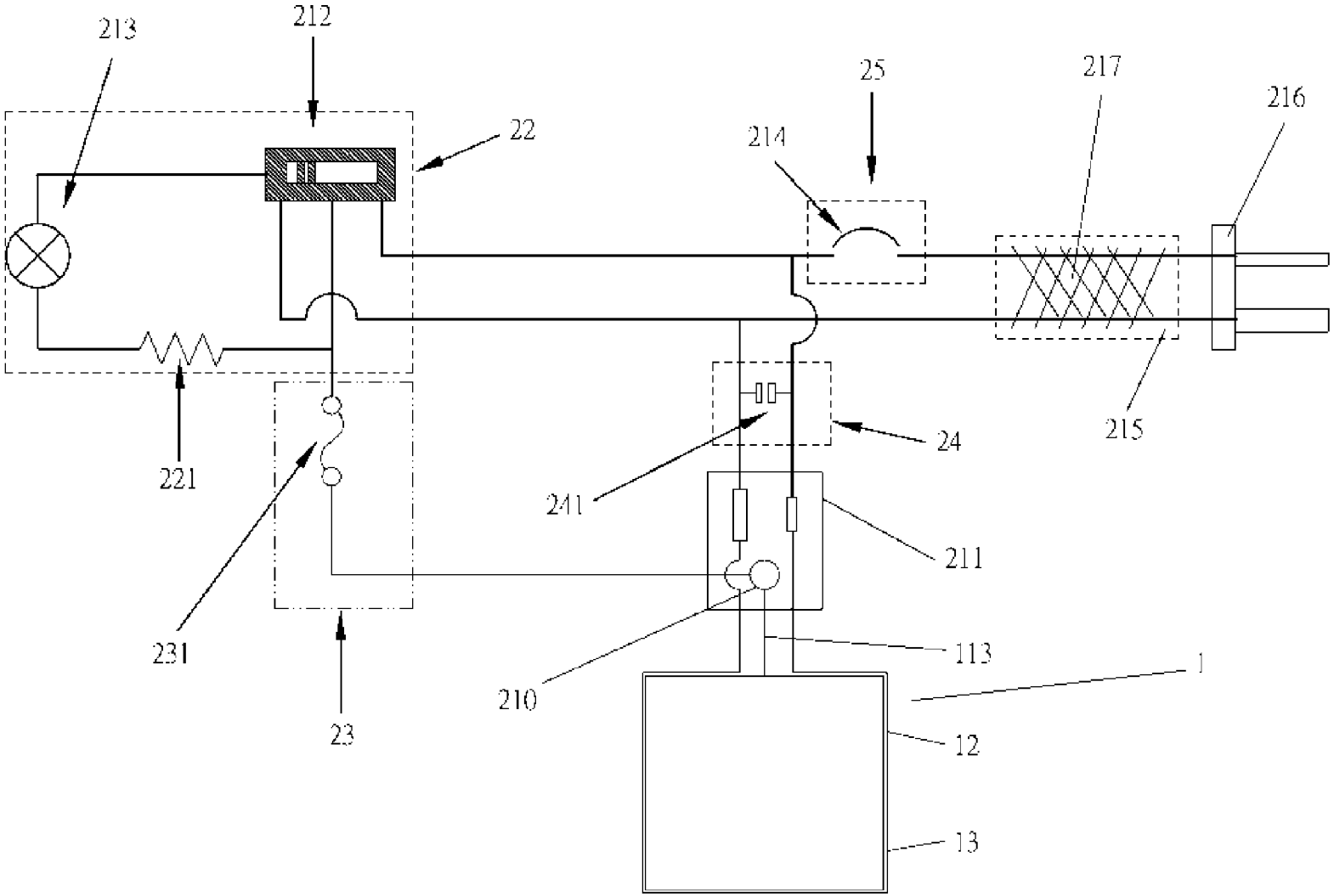
FIG. 2 is a circuit diagram of the electric appliance/extension cord assembly in accordance with the present invention.

Referring to FIGS. 1 and 2, the extension cord 2 comprises a casing 21, a detecting circuit 22, a grounding circuit 23, a surge protection circuit 24, and an overload protection circuit 25. The casing 21 includes one or more three-slot sockets 211. A slide switch 212 is mounted to a front end of the casing 21 and includes a metal housing for grounding purposes when a user touches the metal housing. The slide switch 12 is movable between two positions respectively in association with a hot wire and a neutral wire of a two-slot socket. An indicator lamp 213 mounted on the casing 21 is on when the slide switch 212 is shifted to the hot wire. On the other hand, the indicator lamp 213 is off when the slide switch 212 is shifted to the neutral wire.

A fuseless overcurrent switch 214 is mounted on a side of the casing 211 and of automatically or manually resettable type. A cable 215 extends from the casing 21 and includes a plug 216 with two or three prongs (not labeled) for electrical connection with a two-slot socket or a three-slot socket of an alternating-current power supply. Preferably, the cable 15 is covered with a metal wire-weaved net 217 and capable of shielding from electromagnetic waves.

Referring to FIG. 2, the detecting circuit 22 comprises the slide switch 212 having three contacts, wherein a first contact and a second contact of the slide switch 212 are respectively connected to the hot wire and the neutral wire of the two-slot socket of an alternating-current power supply, and a third contact of the slide switch 212 is connected to a resistor 221, which, in turn, is connected in series to an end the indicator lamp 213. The other end of the indicator lamp 213 is electrically connected to the metal housing of the slide switch 212 for grounding purposes when the user touches the metal housing with his or her hand. As mentioned above, the indicator lamp 213 is on when the slide switch 212 is shifted to the hot wire and the indicator lamp 213 is off when the slide switch 212 is shifted to the neutral wire. The user may select the neutral wire of an alternating-current power supply, and the indicator lamp 213 is off. The slide switch 212 may be a SPDT (single-pole double-throw) slide switch.

The grounding circuit 23 includes a fuse 231 having an end electrically connected to a grounding wire selected by the slide switch 212. The other end of the fuse 231 is electrically connected to a third, grounding slot 210 of a three-slot socket 211 of the extension cord 2. The electromagnetic radiation of the electric appliance can be eliminated through the effective grounding. The fuse 231 may be a resettable PTC (positive temperature coefficient) electric fuse. The temperature coefficient of the fuse 231 changes due to overload. The resistance is thus increased to cut off the circuit, providing the required protection. The circuit is returned to its original conductive state after relief of the overload. Thus, dismantling of the extension cord casing 2 for replacement of the fuse 231 is not required. Alternatively, the fuse 231 may be a conventional meltable fuse.

The surge protection circuit 24 comprises a surge absorber 241 mounted across a hot wire (not labeled) and a neutral wire (not labeled) of the three-slot socket 211. When surge reaches, the resistance becomes zero. Thus, the surge can be guided to the neutral wire, preventing damage to the electric appliance.

The overload protection circuit 25 comprises the fuseless overcurrent switch member 214 with a suitable load according to the number of the three-slot sockets 211. The switch member 214 can be of automatically or manually resettable type and protect the whole extension cord from overload.

When the plug 216 of the extension cord 2 is coupled with a two-slot socket of an alternating-current power supply, electromagnetic radiation extends to the extension cord 2. Use of the cable 215 covered with a metal wire-weaved net 217 shields from the electromagnetic waves.

The electromagnetic radiation generated during operation of the electric appliance body 1 can be guided via the grounding prong 112 via the shielding conductive layer 13 and the power line 113 and then effectively grounded via the socket 211 of the extension cord 2. Adverse affect by the electromagnetic radiation to the human body is thus avoided.

As apparent from the foregoing, the electric appliance/extension cord assembly in accordance with the present invention can effectively shield from the electromagnetic radiation while allowing coupling with either a two-slot socket or three-socket of an alternating-current power supply. Further, the extension cord 2 includes plural three-slot sockets 211 and thus allows simultaneous use of several electric appliances without the risk of electromagnetic radiation.

Although a specific embodiment has been illustrated and described, numerous modifications and variations are still possible without departing from the essence of the invention. The scope of the invention is limited by the accompanying claims.

What is claimed is:

1. An electric appliance/extension cord assembly with an electromagnetic radiation-shielding function, comprising:

an electric appliance comprising a body having a plug with three prongs, the body further comprising a housing and a shielding conductive layer in the housing, the shielding conductive layer being electrically connected to a grounding prong of the plug of the electric appliance; and an extension cord comprising a casing and a plug, the casing comprising a plurality of three-slot sockets, the plug of the extension cord being adapted to couple with a two-slot socket, the plug of the electric appliance being coupled with one of the three-slot sockets of the extension cord, the extension cord further comprising a detecting circuit for detecting a hot wire and a neutral wire of the two-slot socket.

2. The electric appliance/extension cord assembly with an electromagnetic radiation-shielding function as claimed in claim 1 wherein the detecting circuit comprises a slide switch and an indicator lamp, the slide switch comprising a metal housing, the indicator lamp being electrically connected in series to a resistor.

3. The electric appliance/extension cord assembly with an electromagnetic radiation-shielding function as claimed in claim 1 wherein the extension cord further comprises a grounding circuit mounted between the neutral wire of the two-slot socket and a grounding slot of said one of the three-slot sockets, the grounding circuit comprising a resettable positive temperature coefficient electric fuse or a meltable fuse.

* * * * *